US005357942A

United States Patent [19]

Williams et al.

[11] Patent Number: 5,357,942

[45] Date of Patent: Oct. 25, 1994

[54] GREASE SHIELD FOR RANGE CONTROLS

[76] Inventors: Lawrence Williams; Jason L. Williams, both of 12170 Crowe Rd., Milan, Mich. 48160

[21] Appl. No.: 52,905

[22] Filed: Apr. 27, 1993

[51] Int. Cl.[5] ..... F24C 15/12

[52] U.S. Cl. ..... 126/211; 126/299 C

[58] Field of Search ..... 126/42, 211, 299 C; 160/108

[56] References Cited

U.S. PATENT DOCUMENTS

| | | | |
|---|---|---|---|
| 1,564,277 | 12/1925 | Rolland | 126/42 |
| 1,791,696 | 2/1931 | Alexander | 126/211 |
| 1,998,777 | 4/1935 | Dollinger | 160/108 |
| 2,340,173 | 1/1944 | Cash | 126/299 C |
| 2,580,103 | 12/1951 | Keller et al. | 126/299 C |
| 2,836,171 | 5/1958 | Cripe | 126/214 |
| 3,043,289 | 7/1962 | Fox | 126/42 |
| 3,719,220 | 3/1973 | Small | 160/108 |
| 4,037,581 | 7/1977 | Trifiletti | 126/39 |
| 4,157,705 | 6/1979 | Caan | 126/211 |
| 4,237,856 | 12/1980 | Trombatore | 126/299 |
| 4,483,314 | 11/1984 | Parker, Jr. et al. | 126/42 X |
| 4,747,392 | 5/1988 | Rogers | 126/299 |
| 5,117,807 | 6/1992 | Graulich | 126/42 X |

FOREIGN PATENT DOCUMENTS

| | | | |
|---|---|---|---|
| 0251974 | 1/1988 | European Pat. Off. | 126/299 C |
| 0298858 | 1/1989 | European Pat. Off. | 126/42 |
| 2602835 | 7/1977 | Fed. Rep. of Germany | 126/42 |

*Primary Examiner*—Carl D. Price

*Attorney, Agent, or Firm*—Beaman & Beaman

[57] ABSTRACT

A grease or splatter shield for kitchen ranges and stoves comprising a flexible vinyl material having an edge mounted upon the range adjacent the burner controls whereby the shield may be extended to overlie and protect the controls during cooking, and retracted to provide access to the controls. In a variation, the shield may be wound upon an auto-wind roller mounted upon the range permitting the shield to be readily extended, and automatically retracted.

5 Claims, 1 Drawing Sheet

GREASE SHIELD FOR RANGE CONTROLS

BACKGROUND OF THE INVENTION

1. Field of the Invention

The invention pertains to grease and splatter guards for ranges and stoves to protect the burner controls during cooking.

2. Description of the Related Art

As is commonly experienced, the cooking of food within open pans and utensils upon a range or stove often results in liquids within the pan, such as grease, splattering from the pan upon the range cooking surface, and adjacent surfaces, such as counters, risers and other range components. Such splattering often contaminates the burner control knobs which may be mounted behind the cooking surface, or may be located at the forward edge of the range cooking surface. As the burner controls protrude, and are disposed adjacent each other, cleaning around the control knobs to wipe up the splattered grease is troublesome and difficult, and careless cleaning results in unhygienic conditions.

As grease splatter is commonly experienced during cooking, various attempts have been made to control this problem. A variety of shields have been proposed for mounting upon the cooking surface of ranges and stoves for confining grease splatter, as shown in U.S. Pat. Nos. 2,836,171; 4,157,705 and 4,237,856. Also, it is known to use splatter guards in ovens, such as shown in U.S. Pat. Nos. 4,037,581 and 4,747,392 wherein a dome or similar cover is designed to extend over the cooking food. The devices shown in these patents are of a rigid nature, not readily storable, often require expensive range modification and accommodation, and in themselves, are difficult to clean and maintain in a hygienic condition.

Splatter guards and covers of the type previously known are, generally, unsatisfactory, and until the advent of the invention a practical, low cost, easily cleanable grease shield or splatter guard has not been available to the general public.

OBJECTS OF THE INVENTION

It is an object of the invention to provide a grease shield for ranges which is of low cost, easily used and cleaned, and is capable of effectively shielding the controls of a burner or stove during cooking, and yet, may be readily retracted so as to provide accessibility to the controls.

Another object of the invention is to provide a grease shield which may be readily mounted upon a wide variety of range constructions and configurations, and which, selectively, may be extended to shield the burner controls from grease, or retracted from the controls for accessibility.

An additional object of the invention is to provide a grease shield formed of a flexible material, such as vinyl, capable of being wound upon a range mounted roller for unwinding to an extended position for protecting the burner controls, and may be automatically rewound to a retracted position for burner control accessibility.

SUMMARY OF THE INVENTION

Electric kitchen ranges and stoves basically consist of a cooking surface having electric or gas burners mounted therein. The range often includes a riser or vertical member extending from the rear of the cooking surface, and the burner controls are often located on this vertical riser. Also, it is common to mount the burner controls at the front of the cooking surface, often in a panel intersecting the cooking surface at an oblique angle. In either instance, the cooking of foods in an open pan on the burners will result in grease and other liquids splattering from the pan upon the controls, soiling the see, and such foreign matter will accumulate upon the controls and surrounding panels and surfaces if not regularly wiped or washed clean. The invention is directed to a flexible shield, preferably of a transparent vinyl material, which may be extended to a position overlying the range controls to protect the same against splatter, and because of the flexible nature of the shield, it may be easily folded or moved to a retracted position for burner control accessibility.

In the practice of the invention, the grease shield is formed of a flexible vinyl material which may be easily wiped clean with a damp or soapy cloth. The shield is flexible in nature, though impervious to liquids and grease, and may be folded upon itself without injury to the shield material.

The shield includes an upper edge which is fastened to the range by suitable fasteners, and preferably such fasteners take the form of magnets capable of adhering to the ferrous range sheet metal. The opposite edge of the shield is preferably provided with a substantially rigid and elongated dowel, or shaft, which provides weight and maintains the configuration of the extended shield. Also, a small handle may be mounted upon the dowel, or the shield material, adjacent this opposite edge for facilitating lifting of the shield to its retracted control accessible position.

Because the shield is formed of a vinyl material it may be easily cut to accommodate the particular dimensions of the range with which it is being employed, and no special skills are required to size the shield to a particular range, or attach the shield thereto.

In a variation, the upper edge of the shield may be attached to a self-wind roller, such as similar to a shade roller having an internal spring and latch system, whereby winding of the shield upon the roller permits the shield to be fully retracted, and the shield may be extended over the range controls merely by pulling upon the shield free end and extending the same. The automatic latch, and return spring, associated with a roller per,nits the shield to be automatically rewound upon the roller to a retracted position as desired.

BRIEF DESCRIPTION OF THE DRAWINGS

The aforementioned objects and advantages of the invention will be appreciated from the following description and accompanying drawings wherein.

DESCRIPTION OF THE PREFERRED EMBODIMENTS

Figure 1:
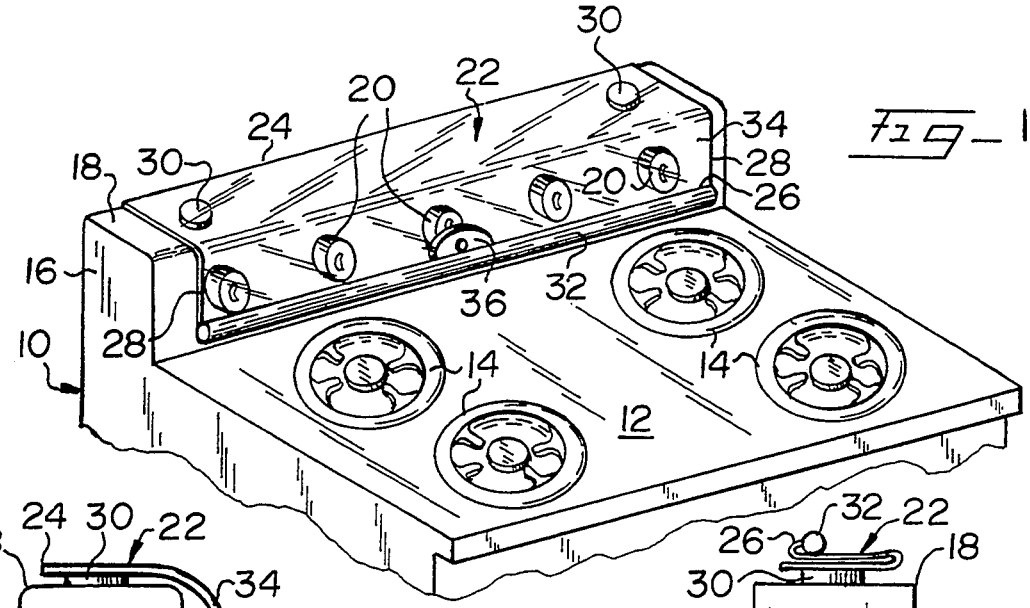
FIG. 1 is a perspective view of the cooking surface and controls of a range illustrating a grease shield in accord with the invention in an extended position overlying the burner controls.

With reference to the drawings, a typical range or stove is illustrated at 10 and includes a horizontal cooking surface 12 in which the burners 14 are located. The burners may be either electric or gas, and the illustrated range 10 includes a rear back splash or riser 16 extending vertically above the cooking surface 12 having a top surface 18, and the burner controls 20 are mounted in the front surface of the riser 16. The controls 20 usually consist of rotary knobs indexable between various burner and oven settings.

As is commonly experienced, the cooking of foods within open pans, not shown, upon the burners 14 will result in the grease and liquids within the pans splattering upon the surface 12, the front and top 18 of the riser 16, and upon the controls 20, requiring frequent cleaning.

Figure 4:
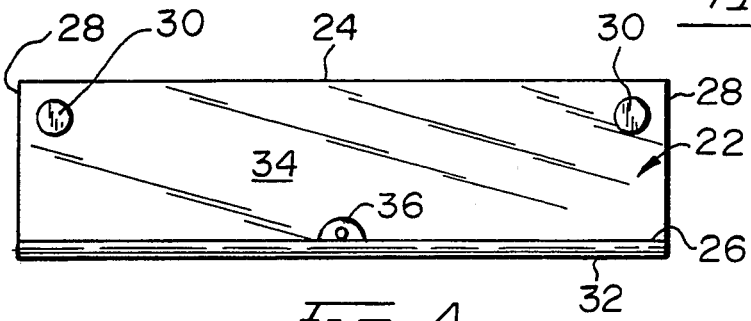
FIG. 4 is an elevational view of the grease shield, per se, in the extended condition.
Figure 5:
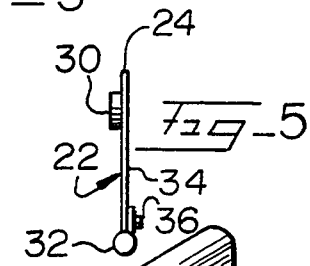
FIG. 5 is an end elevational view of the grease shield as taken from the left of FIG. 4.

In order to protect the riser 16 and controls 20 from splattering grease and liquids during cooking, a shield 22 is employed. The shield 22 is preferably formed of a flexible transparent vinyl material impervious to grease and other cooking foreign matter which may be easily wiped clean of the splattering which will engage the shield. As will be appreciated from FIG. 4, the shield 22 is of a rectangular configuration having a top edge 24, a bottom edge 26, and spaced parallel lateral edges 28.

The shield 22 is attached to the range by a pair of magnets 30 bonded to a common side of the shield 22 adjacent the top edge 24. The magnets 30 may be metal, or ceramic, and are of sufficient strength to hold the shield in position during use.

A dowel shaft 32 is affixed to the shield bottom edge 26 throughout the length of the edge. The dowel 32 may be formed of wood, or may be of synthetic plastic or other material, and is substantially rigid in nature and has sufficient weight to hold the shield in position when extended. The central region of the shield 22 is indicated by reference numeral 34, such region being that portion of the shield between the edges 24 and 26.

If desired, a knob 36 may be mounted on the shield 22, or on the center of the dowel 32, to facilitate grasping of the shield for retraction.

Figure 2:
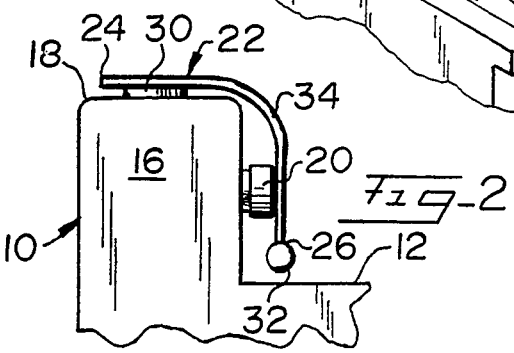
FIG. 2 is an end elevational detail view of the structure of FIG. 1, as taken from the left thereof.

In use, the magnets 30 are placed upon the riser top 18 and are held thereto by magnetic attraction. As will be appreciated from FIGS. 1 and 2, the weight of the dowel 32 causes the shield central region 34 to extend over the front edge of the riser 16 such that the shield central region will overlie the range controls 20 and shield the range controls from grease and splatter during cooking.

Figure 3:
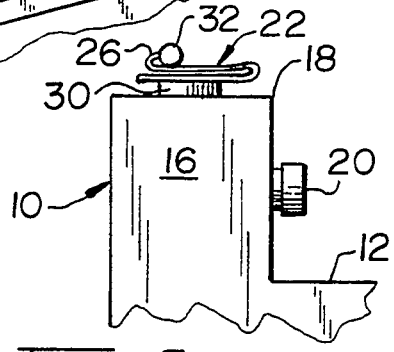
FIG. 3 is an end elevational detail view of the range and grease shield similar to FIG. 2 illustrating the grease shield in a folded retracted position.

When it is desired to have access to the controls 20, the knob 36 centrally located on the shield 22 adjacent the dowel 32, may be lifted by the fingers and the shield raised and folded upon the riser top 18 as shown in FIG. 3 wherein the shield will be in its retracted position providing full access to the control knobs 20. During most usage of the range 10, the shield 22 will be in the folded position shown in FIG. 3 where it is out of the way and full access to the knobs 20 is possible.

The grease and foreign matter striking the outer side of the shield 22 may be easily wiped from the shield, dowel 32 and knob 36, and very little maintenance is required to keep the shield in a clean and hygienic condition.

It will be appreciated that by using a vinyl material for the shield 22, and by using a wood dowel 32, that the width of the shield may be easily trimmed, and cut as desired to accommodate particular sizes of ranges.

Figure 6:
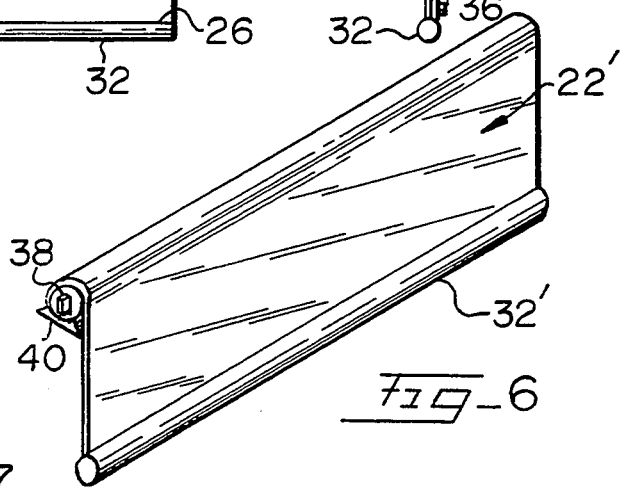
FIG. 6 is a perspective view of a variation of grease shield as wound upon an auto-wind roller illustrating the shield in the extended position.
Figure 7:
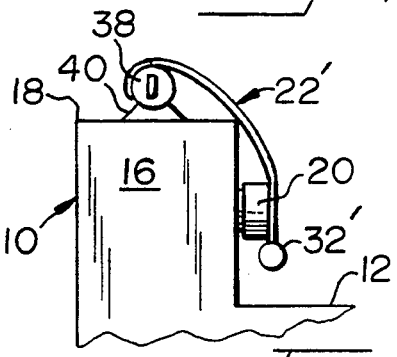
FIG. 7 is an end elevational detail view of the grease shield embodiment of FIG. 6 as mounted upon a range illustrating the shield in the extended position.

An alternative support for the grease shield in accord with the inventive concept is shown in FIGS. 6 and 7. In these figures, components identical to those previously described with respect to the shield are indicated by primes.

In the embodiment of FIGS. 6 and 7, a roller 38 is affixed to the upper edge of the shield 22'. The roller 38 is of the type commonly used with pull window shades wherein the roller includes an internal winding spring and a locking latch detent wherein the locking detent prevents rewinding of the roller until desired wherein a short pull or unwinding of the roller will unlatch the detent.

The roller 38 is mounted upon a bracket 40 which is attached to the riser top 18 by an adhesive, Velcro fastener, or the like. The shield 22' is wound upon the roller 38 in its normal stored retracted position for providing access to the range controls 20. When it is desired to extend the shield 22' over the controls 20, the dowel 32' may be grasped and pulling upon the dowel will extend the shield 22' as it rotates the roller 38 and unwinds therefrom. This rotation of the roller 38 winds the spring, not shown, located within the roller, and upon the shield 22' being fully extended the termination of tension on the shield 22' will permit the roller latch detent, not shown, to engage and the shield 22' will overlie the range controls 20 as shown in FIG. 7.

When it is desired to retract the shield 22' a short pull on the dowel 32' will unlatch the roller detent and permit the roller spring to automatically rewind the roller 38 to wind the shield 22' thereon and retract the shield to provide range control access. Of course, cleaning of the shield 22' occurs when the shield is extended and the shield may be wiped by a damp or soapy cloth.

It will be understood that the embodiment of FIGS. 1–4 can also be used with range controls located at the front of the cooking surface 12, on an oblique panel, for instance. In such an arrangement the magnets 30 can be placed upon the surface 12 above the control knobs.

It is appreciated that various modifications to the inventive concepts may be apparent to those skilled in the art without departing from the spirit and scope of the invention.

We claim:

1. In combination, a ferro-magnetic range having a cooking surface having burners and burner range controls located adjacent the cooking surface, and a support surface located adjacent and above said controls, a flexible shield formed of a flexible synthetic plastic film having a first edge, a second edge, lateral edges and a central region located intermediate said first and second edges, a pair of magnets mounted on said shield adjacent said first edge attached to said support surface mounting said shield at said first edge to said range support surface above said range controls, said shield central region between said first and second edges and between said lateral edges, being of sufficient dimension to permit said shield central region to overlie the range controls when in an extended lowered position to protect against grease splatter and the flexibility of said shield permitting said shield to be displaced to a retracted raised position to render the range controls accessible, and a rigid elongated weight mounted on said shield adjacent to and extending the length of said second edge.

2. In a grease shield for range controls as in claim 1, said shield being formed of a vinyl material.

3. In a grease shield for range controls as in claim 2, said shield being formed of a transparent film of vinyl material.

4. In a grease shield for range controls as in claim 1, said weight comprising a cylindrical dowel.

5. In a grease shield for range controls as in claim 1, a handle defined on said shield adjacent said second edge.

* * * * *